US005890886A

United States Patent [19]

Döker et al.

[11] Patent Number: 5,890,886

[45] Date of Patent: Apr. 6, 1999

[54] BURNER FOR HEATING SYSTEMS

[75] Inventors: Andreas Döker, München, Germany; Werner Koller, Effretikon; Willy Tauscher, Winterthur, both of Switzerland; Franz Durst, Langensendelbach, Germany; Dimosthenis Trimis, Nürnberg, Germany; Olaf Pickenacker, Langensendelbach, Germany

[73] Assignee: Sulzer Chemtech AG, Winterthur, Switzerland

[21] Appl. No.: 897,800

[22] Filed: Jul. 21, 1997

[51] Int. Cl.[6] ..... F23D 14/12

[52] U.S. Cl. ..... 431/328; 431/170

[58] Field of Search ..... 431/328, 7, 170

[56] References Cited

U.S. PATENT DOCUMENTS

| | | | |
|---|---|---|---|
| 3,088,271 | 5/1963 | Smith | 431/328 |
| 5,306,140 | 4/1994 | Smith | 431/328 |
| 5,441,402 | 8/1995 | Reuther | 431/328 |
| 5,522,723 | 6/1996 | Durst et al. | 431/328 |
| 5,667,374 | 9/1997 | Nutcher | 431/328 |

*Primary Examiner*—Carroll B. Dority

*Attorney, Agent, or Firm*—Townsend and Townsend and Crew LLP

[57] ABSTRACT

A packing as a porous body for burners, in particular for heating systems, is provided with a housing having an inlet for a gas/air mixture as a combustable gas mixture, a combustion chamber, an ignition device in the combustion chamber and an exhaust gas outlet. The combustion chamber is at least partly filled with a three-dimensional ordered packing of heat resistant ceramic material, foil material, or sheet metal material having continuous hollow cavities for the formation of a defined flame zone.

17 Claims, 4 Drawing Sheets

BURNER FOR HEATING SYSTEMS

BACKGROUND OF THE INVENTION

1. Field of the Invention

The present invention relates to a burner, and more particularly, to a burner for heating systems.

2. Description of Prior Art

Various concepts are known from the prior art for the reduction of the noxious substances, such as $NO_x$ or CO, which arise during combustion. Since the $NO_x$ production is large at high combustion temperatures, one attempts, for example, to keep the flame temperature low. For this purpose a heating boiler has been proposed, for example in EP 0 256 322 B1, in which a fuel gas is burned at a temperature of less than 700° C. through the use of a catalyst of the platinum group, whereby the creation of nitrogen oxides is prevented. However, such catalysts have only a relatively low working life and are, moreover, very costly. The essential disadvantage of catalytic combustion, however, lies in the fact that its flame temperature is too low, which does not permit any effective exploitation of the heat and thereby only allows the construction of a burner with a low power density.

In addition to this, there are burners which operate in accordance with the process of exhaust gas recirculation. Here a part of the exhaust gas is returned into the flame, whereby an optimized, pollution reduced combustion is achieved. A stable flame arises with the burner model "RotriX" of the Viessmann company through an intentional decay of the turbulent fuel/air mixture, which has been set into rotation. The exhaust gas recirculation rate can be further increased by a flameless oxidation at a free surface. According to the specialist paper by J. A. Wünning and J. G. Wünning: "Brenner für die flammlose Oxidation mit geringer NO-Bildung auch bei höchster Luftvorwärmung" (Burner for the flameless oxidation with low NO-formation even with the highest air pre-heating), in GASWÄRME International, Vol. 41 (1992), No. 10, pages 438 to 444, the flameless oxidation is usable in burners with process temperatures over 850° C. This process, however, involves high constructional cost and complexity because auxiliary burners are required, for example, for the heating up of the fuel/air mixture to ignition temperature.

A further concept is present in the form of the "Thermomax-Burner" of the company Ruhrgas AG, which is treated in the specialist paper by H. Berg and T. Jannemann "Entwicklung eines schadstoffarmen Vormischbrenners für den Einsatz in Haushalts-Gaskesseln mit zylindrischer Brennkammer" (Development of a low-pollution pre-mixing burner for use in domestic gas boilers with a cylindrical combustion chamber), in GASWÄRME International, Vol. 38 (1989), No. 1, pages 28 to 34. The combustion takes place there in a flameless manner at the surface of a metallic, apertured sheet, which transmits the heat energy produced out of the reaction zone principally by radiation. The combustion temperature is kept to approximately 800° C. through this giving off of heat, which in turn has the consequence of a reduction of the emission of pollution. Burners of this type of construction typically have a thermal surface loading of 300 $kW/m^2$.

An increase of the thermal loading to approximately 3000 $kW/m^2$ is achieved by a burner which is known from DE 43 22 109 A1. There, a part of the combustion chamber, in which a flame propagates, is completely filled with a porous material whose porosity changes along the flow direction of the fuel gas/air mixture in such a way that a critical Péclet number results at a boundary surface, or in a specific zone of the porous material, from which point on a flame can arise. With regard to the Peclet number, the following should be explained:

With a specific pore size of the porous material, the production of heat by chemical reactions in the flame and the dissipation of heat by the porous medium are equal so that beneath this pore size no flame can arise but above it a free ignition occurs.

This condition is described with the aid of the Péclet number, which recites the ratio of heat production to heat dissipation. In this way a critical Péclet number results for the flame propagation. A self-stabilizing flame within the supercritical zone results through the provision of a subcritical zone and a supercritical zone with respect to the Péclet number.

Through the arrangement set forth in DE 43 22 109 A1, the problem of the stability of a flame burning in a porous medium is solved under the side conditions of a low temperature and thus a low emission of pollution. Ceramic foams or bulk fillings of balls are proposed as porous material. These materials have, however, a relatively low porosity, whereby combustion space is wasted and the gas/air mixture is exposed to a higher flow resistance. Moreover, these materials restrict, as a result of their low optical permeability, the energy transport on the basis of the thermal transport mechanism of thermal radiation which dominates in the present temperature range. This leads to a situation—from a specific constructional size of a burner of this kind onwards—in which the heat produced cannot be dissipated sufficiently well outwardly from the inner region of the combustion space. The local overheating in the porous material brought about in this way leads to material damage by thermal strains and an increased output of pollutants.

SUMMARY OF THE INVENTION

The present invention is thus based on the object of providing a porous medium for a burner which has a high porosity and thus a high optical permeability and which is also insensitive with respect to thermal strains. Moreover, it should be possible to manufacture the porous medium in a simple manner from the technical manufacturing viewpoint, at a favorable cost and with constant precision.

In accordance with one aspect of the present invention the combustion space of the burner is at least partly filled by a three-dimensional ordered packing having connected cavities and consisting of ceramic material, foil material or sheet metal material for the formation of a defined flame zone.

Such ordered packings can basically be manufactured with the required high porosity of up to approximately 99% and thus offer a larger combustion space than, for example, ceramic foams or bulk fillings of ceramic bodies. As a result of the high optical permeability of such packings, the thermal transport by thermal radiation is not blocked so that a rapid and effective heat dissipation to the thermal transfer medium is ensured. Furthermore, these packings have a low flow resistance as a result of the open structure.

Thus, the pressure drop of the gas flow when flowing through the combustion space can be reduced, which lowers the required energy input. The known manufacturing methods for such packings furthermore enable their production in a simple manner from a technical manufacturing viewpoint and at favorable cost, with invariable precision with respect to the dimensioning of the hollow cavities. The latter can be varied in their size without great complexity. The packings have, as a result of their three-dimensional structure, the further advantage that they react resiliently to thermal or mechanical loading, whereby the danger of points of fracture, such as exists, for example, with the foam-like ceramic parts used in the prior art, is overcome.

Since the packings of the invention can be manufactured with much higher degrees of porosity when compared with the prior art, the proportion of material related to the total volume is very low. This leads to a considerable shortening of the response times of the burner in comparison to the previously known porous media. Moreover, such packings can be made variable with respect to their diameter, length, hydraulic diameter etc., whereby an ideal fluid dynamic design can be achieved.

Ordered packings which are used as static mixers have, in addition to a low pressure drop and optical permeability, also other characteristics which have a positive benefit. The pronounced transverse mixing leads to homogeneous concentration profiles and temperature profiles of the combustion gases, which favourably influences the combustion process and further reduces the production of pollution because no cold points and no so-called hot spots occur. Stagnating zones and also break-throughs of the flow media are prevented because of the low back mixing, and the combustion zone is additionally stabilized in the flow direction.

Furthermore, it can be of advantage to use two or more packing elements, which are arranged rotated relative to one another. In this way a homogeneous distribution of concentration, temperature and flow speed is ensured over the entire flow cross section.

The above advantages are in particular achieved by a packing which consists of a material which is resistant to temperatures in the range between 1200° C. and 2000° C.

Ordered packings such as, for example, static mixers, which are built up of layers of corrugated lamella, or lamella folded in zig-zag-like manner, which form channels have proved to be particularly suitable, with the channels of neighboring layers crossing one another and with the lamella consisting of metallic and/or ceramic materials, whereby the packing can also be of monolithic construction.

In accordance with another aspect of the present invention the lamella can be foils or metal sheets which are arranged loosely alongside another and which have a plurality of perforations.

Another type of ordered packing is made of webs which intersect cross-wise and have the same features as packings which are formed of corrugated lamella.

In accordance with another aspect of the present invention the packing can be built up of layers of webs which cross each other and consist of metallic and/or ceramic materials.

In accordance with another aspect of the present invention the packing can consist of ceramic materials, with the principal components being $Al_2O_3$, $ZrO_2$ or SiC. These materials have advantages with respect to temperature resistance and corrosion resistance.

The advantages listed are in particular achieved by a packing which has a high hollow space component or proportion, i.e. a high porosity of at least 70% and a wave height of the layers, or a web width, of between 3 mm and 15 mm (claim 7). With these geometrical data, low pressure drop and low emissions of pollutants can be realized.

In accordance with another aspect of the present invention the packing in the combustion chamber can be catalytically coated or can be manufactured of a catalytically active material, i.e. it is itself catalytically active. In this way very low pollution emission values are achieved.

In accordance with a further aspect of the present invention a porous body is placed in front of the inlet zone of the ordered packing. It functions as a flame holder or flame barrier in that it ensures that the Péclet number present there is subcritical, preferably smaller than 65. This porous body can be formed as an ordered packing.

The present invention also provides measures for the defined restriction of the flame zone of the burner with the operation taking place with a flame holder of conventional construction known from the prior art; at the same time the mixing between the gaseous or vaporous fuel in the air is made more intense by the finely pored body. In this way conventional burners with free flame formation, which normally have such flame holders, can be retrospectively equipped with packings in accordance with the invention. In this way a cost favorable possibility is provided for the reduction of pollution of burners which are already in use.

In an alternative embodiment finely porous material is arranged in the throughflow direction of the gas/air mixture upstream of the flame zone defined by the packing. No flame can form in this finely porous material because of its subcritical Péclet number. Thus, the concept known from DE 43 22 109 A1 for flame stabilization can be combined with the present invention.

The finely pored material, which can be produced without problems as an ordered packing with a porosity having a Péclet number which is in particular smaller than 65, can be manufactured in analogous manner from temperature resistant ceramic material, foil material or sheet metal material, in the same way as the actual ordered packing in the combustion chamber.

In this arrangement this finely pored packing not only serves for the flame stabilization but rather the combustion gases such as, for example, natural gas, methane or heating oil vapor are homogeneously mixed with air before the actual combustion chamber as a result of the transverse mixing characteristics. This additionally favorably influences the combustion process, in particular with respect to the emission of pollutants.

DETAILED DESCRIPTION OF THE PREFERRED EXEMPLARY EMBODIMENTS

Figure 1:
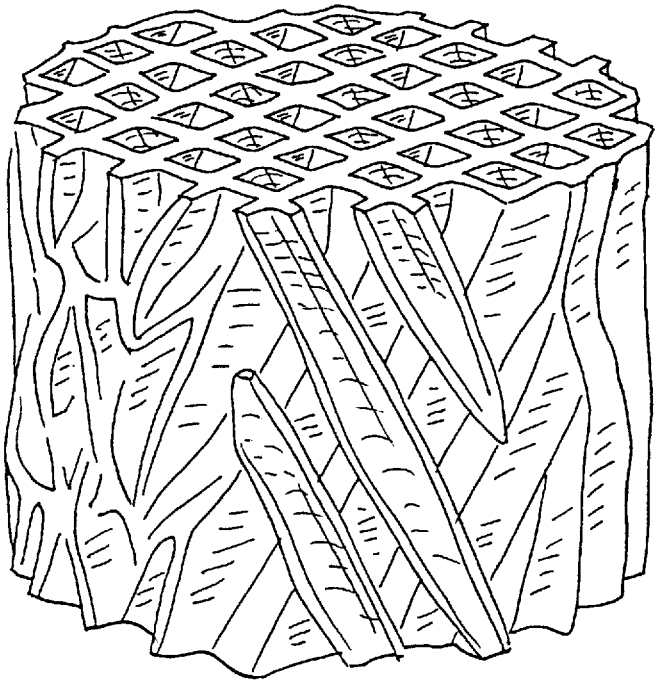
FIG. 1 is an ordered packing of ceramic material.

The ordered packing shown in FIG. 1 is put together from a plurality of corrugated ceramic plates. These ceramic plates are so arranged that the corrugations of two neighboring corrugated plates form an angle of 60°. In this way open channels result which cross each other.

Figure 2:
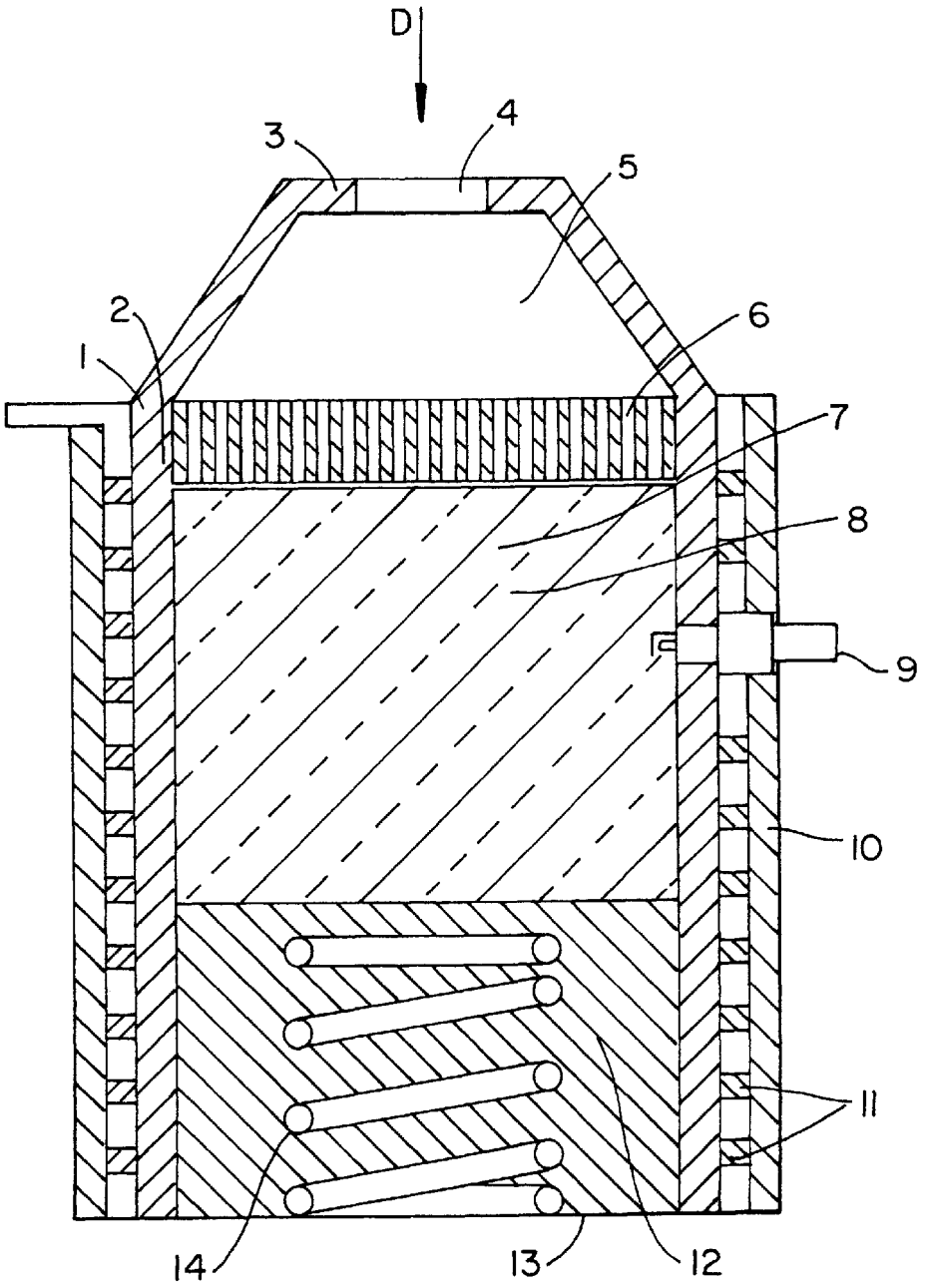
FIG. 2 is a schematic longitudinal section through a burner in a first embodiment.

The burner shown in FIG. 2 has a housing 1 comprising a cylindrical main portion 2 and a truncated, cone-like upper end part 3. The latter has at its upper side an inlet 4 for a gas/air mixture as the combustible gas mixture. In the throughflow direction D of the gas/air mixture the prechamber 5 formed by the end part 3 is followed by a conventional flame holder or a perforated plate 6, through which the gas/air mixture enters into the subsequent combustion chamber 7. This combustion chamber is filled out with an ordered packing 8, which has, for example, the following specifications:

diameter: 70 mm
height: 90 mm
porosity: ca. 95%
corrugation height: 8 mm
material: heat resistant ceramic The gas/air mixture entering into the ordered packing 8 is ignited by an ignition device 9 sitting at the side in the housing 1 at the level of the combustion chamber 7 and burns while forming a defined flame zone within the ordered packing 8 while producing thermal energy. The latter arises to a large part as thermal radiation which heats the main part 2 of the housing. The main part 2 is surrounded by a heat transfer jacket 10 in which helically extending channels 11 are provided. A heat exchanger medium, such as for example water, which circulates through a heating system, flows through these channels.

After the combustion space in the passage direction D, there is further provided an exhaust gas space 12, in which temperatures between 700° C. and 1300° C. prevail at the inlet of this zone and between 35° C. and 1500° C. at the outlet of this region. The exhaust gas space 12 serves as a cooling zone, with the cooling coil of stainless steel 14 extracting heat from the exhaust gas, which can be used as useful heat. The cooling coil 14 is kept at temperatures below 200° C. by the heat exchanger medium flowing through it so that other materials, in particular aluminium, brass or copper are also possible. The exhaust gas space 12 opens into the exhaust gas outlet 13 of the burner.

Figure 3:
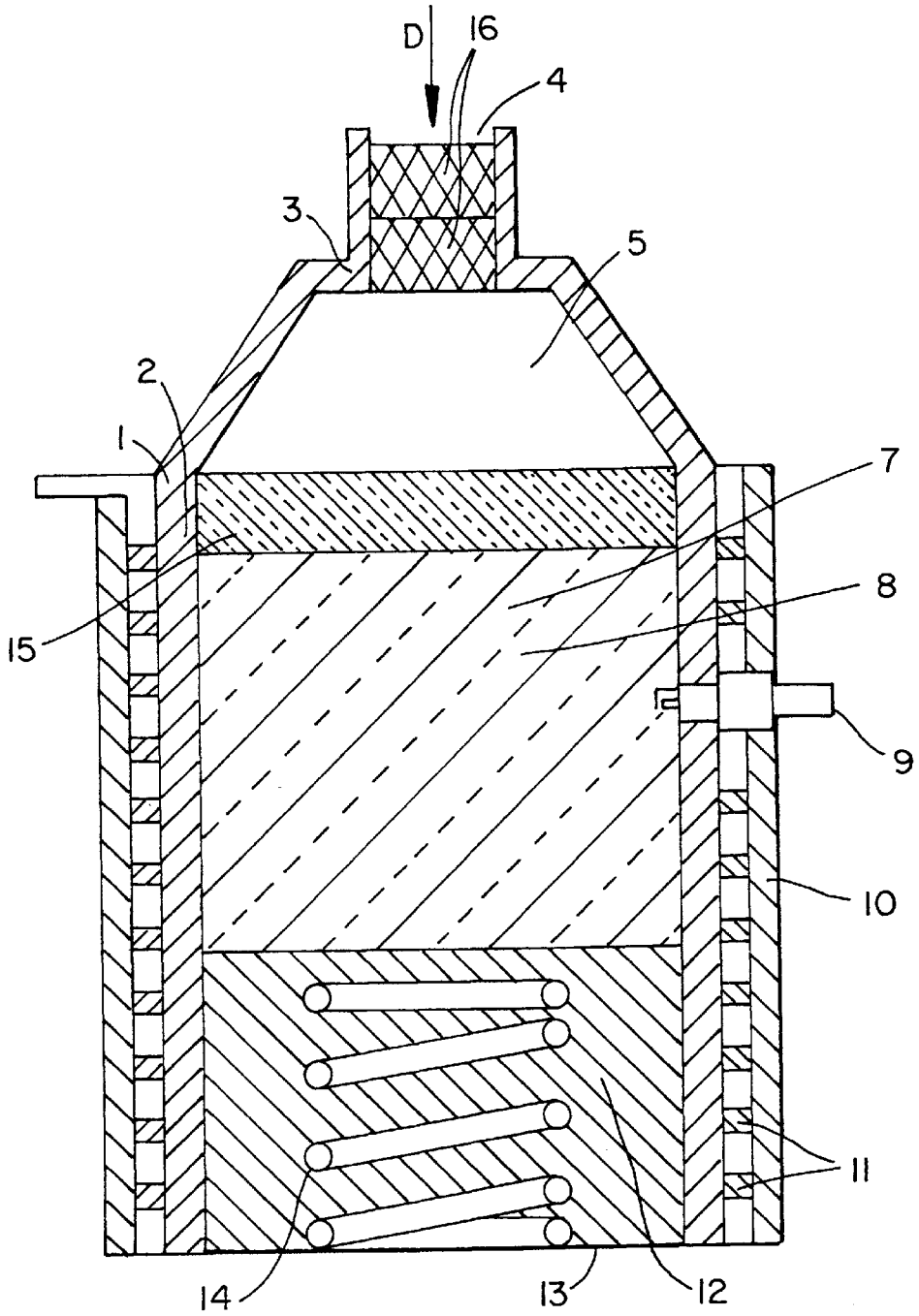
FIG. 3 is a schematic longitudinal section through a burner in a second embodiment.

The burner shown in FIG. 3 is distinguished from the burner in FIG. 2 only in two details. To this extent components are provided which otherwise correspond with the same reference numerals as in FIG. 2 and do not require repeated explanation.

In distinction to FIG. 2, the burner of FIG. 3 has no conventional flame holder. On the contrary, a finely pored packing 15 is arranged in front of the ordered packing 8 when viewed in the throughflow direction D of the gas/air mixture, and is likewise formed from an ordered packing. The latter has a smaller pore size and porosity than the ordered packing 8, so that its Péclet number is smaller than 65 and is thus subcritical. This signifies that no flame can form in the ordered packing 15. The ordered packing 8 is so specified that the Péclet number is supercritical, so that a flame can form there in defined manner.

Moreover, a static mixer 16 is inserted in front of the burner. It brings about a very homogeneous gas/air mixture.

Figure 4:
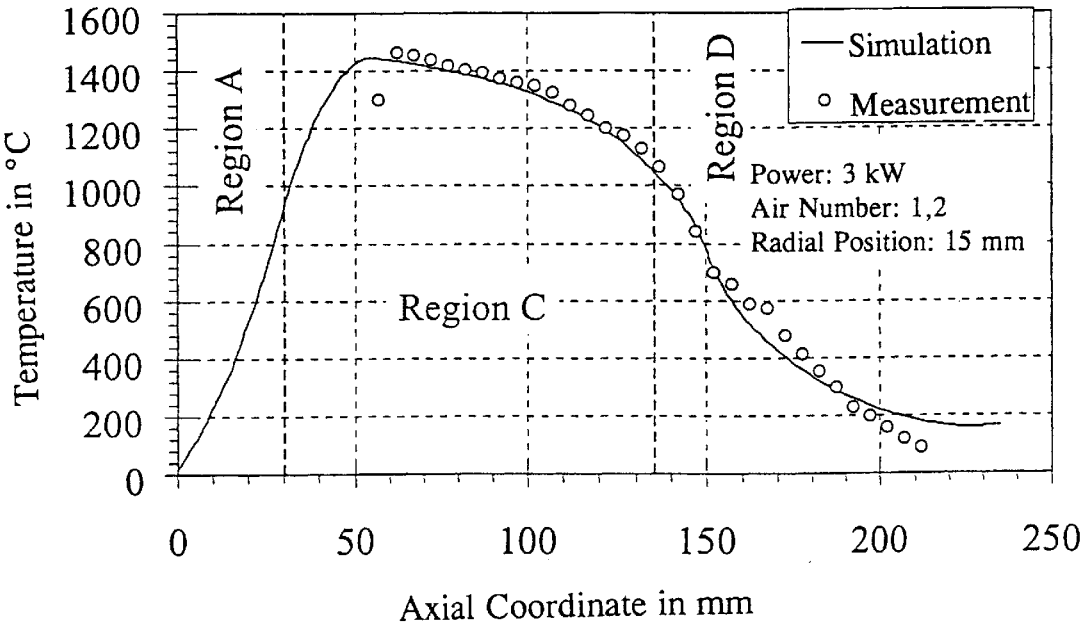
FIG. 4 is a typical axial temperature profile within the burner.

The temperature profile shown in FIG. 4 for a 6 kW natural gas burner with a power of 3 kW and an air number of 1.2 shows that the maximum temperatures arise shortly after the transition between the finely pored region A and the coarsely pored region C and can lie in the range of approximately 1400° C. to 1500° C. In the region D which follows it, the temperatures lie at around 1100° C. at the inlet and sink towards the outlet to temperatures which are of the same order of magnitude as those of the heat exchanger medium.

The gaseous fuel can, for example, also be vaporized heating oil or diesel oil.

Moreover, it should be pointed out that the flame which forms through the ignition of the gas/air mixture in the flame zone defined by the ordered packing 8 propagates in dependence on the ratio of gas to air and also of the quantities thereof. To this extent the power of the burner can be regulated via the quantity of the gas and also of the gas/air mixture.

What is claim is:

1. A burner comprising a combustion chamber in a housing that includes an inlet for air and gaseous fuel, an ignition device, and an exhaust gas outlet, the burner further comprising a porous body that at least partly fills out the combustion chamber, the porous body consisting of heat resistant material and having spatially connected, hollow cavities for the formation of a defined flame zone, a part of the porous body being provided as a flame zone and being formed as an ordered packing, the ordered packing being built up of layers of crossing webs and consisting of at least one of metallic and ceramic materials, porous body being integrated at the inlet region of the ordered packing and having a peclet number that is subcritical.

2. A burner in accordance with claim 1 wherein the ordered packing consists of material that is resistant to an envisaged flame temperature of 1200° C. to 2000° C.

3. A burner in accordance with claim 1 wherein the porosity of the ordered packing amounts to at least 70% and wherein one of either a wave height of the layers or a width of the webs have dimensions in a range between 3 millimeters and 15 millimeters.

4. A burner in accordance with claim 1 wherein the ordered packing has a catalytically active surface.

5. A burner in accordance with claim 1 wherein the porous body integrated at the inlet is formed as an ordered packing.

6. A burner in accordance with claim 1 wherein a static mixture is arranged in an inlet of the housing for production of an air/gas mixture.

7. A burner comprising a combustion chamber in a housing that includes an inlet for air and gaseous fuel, an ignition device, and an exhaust gas outlet, the burner further comprising a porous body that at least partly fills out the combusion chamber, the porous body consisting of heat resistant material and spatially connected, hollow cavities for the formation of a defined flame zone, a part of the porous body being provided as a flame zone and being formed as an order packing, flame zone being formed as an ordered packing, wherein the ordered packing is built up of layers of corrugated lamella that form channels, the channels of adjacent layers crossing one another, the lamella consisting of at least one of metallic and ceramic materials, wherein a porous body is integrated at the inlet region of the ordered packing and has a peclet number that is subcritical.

8. A burner in accordance with claim 7 wherein the lamella are foils or metal sheets that are loosely arranged along side one another and that have a plurality of perforations.

9. A burner in accordance with claim 7 wherein either $Al_2O_3$, $ZrO_2$ or SiC is provided as the ceramic material.

10. A burner in accordance with claim 7 wherein the ordered packing includes a hollow cavity component having a porosity that amounts to at least 70%, and wherein a wave height of the layers has dimensions in a range between 3 millimeters and 15 millimeters.

11. A burner in accordance with claim 7 wherein the ordered packing has a catalytically active surface.

12. A burner in accordance with claim 7 wherein the porous body integrated at the inlet is formed as an ordered packing.

13. A burner in accordance with claim 7 wherein a static mixer is arranged in the inlet of the housing for production of an air/gas mixture.

14. A burner in accordance with claim 7 wherein the ordered packing is built up of lamella folded in a zigzag-like manner.

15. A burner in accordance with claim 7 wherein the ordered packing is of a monolithic design.

16. A burner in accordance with claim 7 wherein the peclet number is smaller than 65.

17. A burner in accordance with claim 1 wherein the peclet number is smaller than 65.

* * * * *